US005890440A

United States Patent [19]

Spur

[11] Patent Number: 5,890,440

[45] Date of Patent: Apr. 6, 1999

[54] MULTI-COMPARTMENT CASH BOX

[76] Inventor: Mark Spur, 299 Chimmry Rock, Stateline, Nev. 89449

[21] Appl. No.: 922,219

[22] Filed: Sep. 2, 1997

Related U.S. Application Data

[63] Continuation of Ser. No. 712,218, Sep. 11, 1996, abandoned, which is a continuation of Ser. No. 119,696, Sep. 10, 1993, abandoned.

[51] Int. Cl.[6] ..... E05G 1/08

[52] U.S. Cl. ..... 109/47; 109/49; 109/53; 109/57; 109/66; 220/525; 232/15; 232/43.2

[58] Field of Search ..... 109/57, 53, 64, 109/66, 45–47, 49, 54, 56; 220/525, 526; 232/43.2, 43.1, 7, 15, 16

[56] References Cited

U.S. PATENT DOCUMENTS

| | | | |
|---|---|---|---|
| 157,555 | 12/1874 | Stokes | 232/15 |
| 269,195 | 12/1882 | Golding . | |
| 527,589 | 10/1894 | Bristol | 232/43.2 |
| 1,005,662 | 10/1911 | Smith | 232/15 |
| 1,058,602 | 4/1913 | Kohler | 232/15 |
| 1,062,134 | 5/1913 | Woods | 232/15 |
| 1,325,197 | 12/1919 | Gregorovius | 232/4 R |
| 1,926,062 | 9/1933 | Rooke . | |
| 2,686,007 | 8/1954 | Hurtig et al. | 232/4 R |
| 3,292,849 | 12/1966 | Ewing | 232/43.2 |
| 4,057,145 | 11/1977 | Wray et al. | 220/525 X |
| 4,412,709 | 11/1983 | Ishii | 312/291 |
| 4,491,269 | 1/1985 | Sweazey et al. | 232/43.2 |
| 4,548,353 | 10/1985 | Howard et al. | 109/53 X |
| 4,746,110 | 5/1988 | Chiba | 271/3.1 |
| 4,790,476 | 12/1988 | Tanaka et al. | 232/1 D |
| 4,944,391 | 7/1990 | Johnson | 206/83 |
| 4,969,597 | 11/1990 | Caplan | 109/53 X |
| 5,055,079 | 10/1991 | Hobson et al. | 446/8 |
| 5,083,704 | 1/1992 | Rounthwaite | 232/43.2 |
| 5,257,577 | 11/1993 | Clark | 232/43.2 X |
| 5,551,571 | 9/1996 | Lin et al. | 206/710 |
| 5,584,486 | 12/1996 | Franklin | 273/293 |

FOREIGN PATENT DOCUMENTS

| | | | |
|---|---|---|---|
| 2829532 | 10/1979 | Germany | 109/48 |
| 8100415 | 9/1981 | Netherlands | 232/43.2 |
| 469173 | 8/1969 | Switzerland | 109/53 |
| 1166303 | 10/1969 | United Kingdom | 70/63 |

*Primary Examiner*—Lloyd A. Gall
*Attorney, Agent, or Firm*—Beyer & Weaver, LLP

[57] ABSTRACT

A multiple compartment cash box assembly including an insert box defining a first compartment and a separate second compartment. A first slot extends into the first compartment and a second slot extends into the second compartment. An access template is included movably coupled to the insert box between a first position and a second position. In the first position, the access template cooperates with the first slot to enable access therethrough into the first compartment while simultaneously cooperatively blocking access to the second compartment through the second slot. In the second position, the access template cooperates with the second slot to enable access therethrough into the second compartment while cooperatively blocking access to the first compartment through the first slot.

56 Claims, 7 Drawing Sheets

MULTI-COMPARTMENT CASH BOX

RELATED APPLICATION

This application is a continuation application of patent application Ser. No. 08/712,218 filed Sep. 11, 1996, now abandoned, which is a continuation application of patent application Ser. No. 08/119,696, filed Sep. 10, 1993, now abandoned.

DISCLOSURE OF INVENTION

Accordingly, it is an object of the present invention to provide a multi-compartment cash box assembly which reduces the labor intensity of changing cash boxes during shift changes.

It is another object of the present invention is to provide a multi-compartment cash box assembly which enables selective access to each compartment.

Another object of the present invention is to provide a multi-partitioned cash box assembly which allows deposition access thereto during multiple shifts without requiring removal of the box.

Still a further object of the present invention to provide a multi-partitioned cash box assembly which is durable, compact, easy to maintain, has a minimum number of components, cost effective to manufacture, and is easy to use by moderately skilled personnel.

In accordance with the foregoing objects, the present invention provides a multiple compartment cash box assembly including an insert box defining a first compartment and a separate second compartment. A first slot extends into the first compartment and a second slot extends into the second compartment. An access template is included movably coupled to the insert box between a first position and a second position. In the first position, the access template cooperates with the first slot to enable access therethrough into the first compartment while simultaneously cooperatively blocking access to the second compartment through the second slot. In the second position, the access template cooperates with the second slot to enable access therethrough into the second compartment while cooperatively blocking access to the first compartment through the first slot.

A latch mechanism is provided selectively movable between a latched position and an unlatched position. In the latched position, the access template is prevented from movement from the first position to the second position, while in the unlatched position, the access template is permitted to move between the first position and the second position.

The cash box assembly further includes a sleeve member formed for receipt of the insert box therein which includes a locking mechanism coupled between the insert box and the sleeve member. The locking mechanism is selectively movable between a locked position, locking the insert box in the sleeve member, and an unlocked position, enabling removal of the insert box from the sleeve member. The access template is further adapted to selectively move from the second position to a release position where the access template causes the locking mechanism to move from the locked position to the unlocked position to enable removal of the insert box. A biasing device biases the access template toward the second position and toward the release position.

In another aspect of the present invention, a multiple compartment cash box assembly is provided having a sleeve member defining an insert opening into a recess thereof. The sleeve member includes a first sleeve slot, a second sleeve slot and a third sleeve slot each extending into the recess from an exterior surface of the sleeve member. An insert box is formed and dimensioned for sliding receipt through the insert opening and into the recess of the sleeve member, and includes a first compartment, a separate second compartment and a separate third compartment. A first partition separates the first compartment from the second compartment, while a second partition separates the second compartment and the third compartment. The insert box includes a first box slot extending into the first compartment, a second box slot extending into the second compartment and a third box slot extending into the third compartment. Each of the first box slot, the second box slot and the third box slot is configured to align with the respective first sleeve slot, the second sleeve slot and the third sleeve slot when the insert box is received in the sleeve member. The cash box assembly further includes an access template extending transversely across the first compartment, the second compartment and the third compartment. This access template is adapted for sliding receipt in a first opening of the first partition and a second opening in the second partition for movement between a first position, a second position and a third position. In the first position, the access template cooperates with the first box slot to enable access therethrough into the first compartment, while cooperatively blocking access to the second compartment through the second box slot and the third compartment through the third box slot. The access template in the second position cooperates with the second box slot to enable access therethrough into the second compartment, while cooperatively blocking access to the first compartment through the first box slot and the third compartment through the third box slot. Finally, in third position, the access template cooperates with the third box slot to enable access therethrough into the third compartment, while cooperatively blocking access to the first compartment through the first box slot and to the second compartment through the second box slot.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
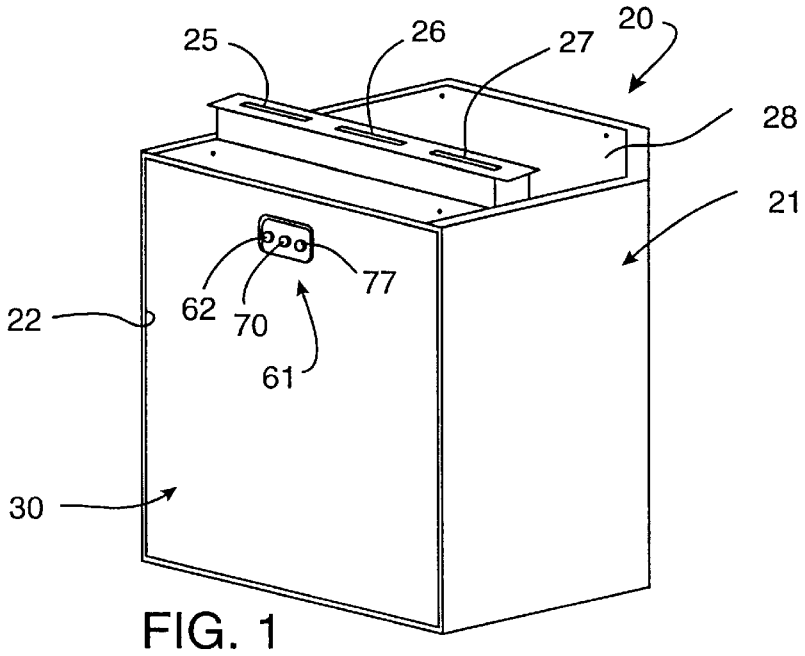
FIG. 1 is top perspective view of a multi-compartment cash box assembly constructed in accordance with the present invention.
Figure 2:
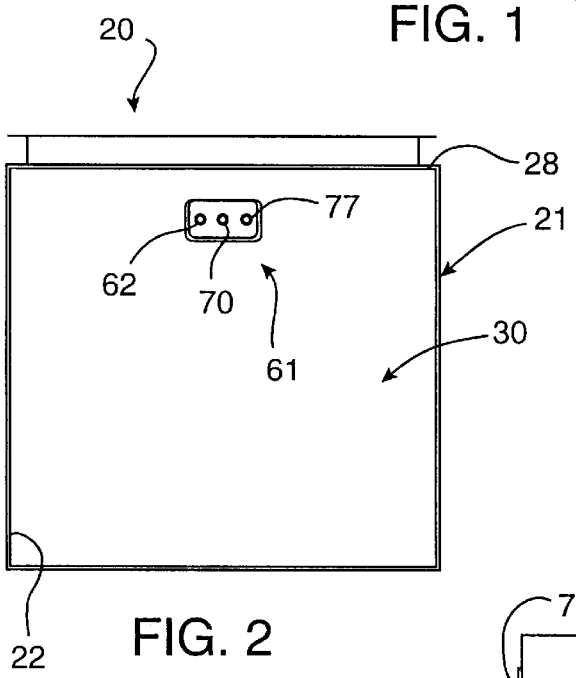
FIG. 2 is a front elevation view of the cash box assembly of FIG. 1.
Figure 3:
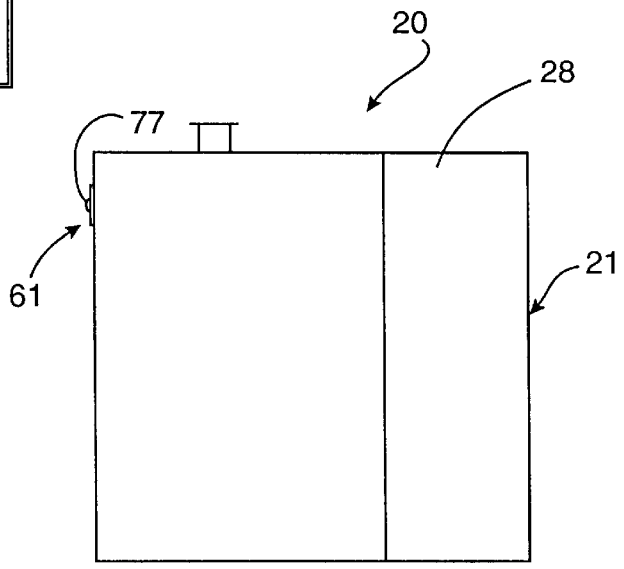
FIG. 3 is a side elevation view of the cash box assembly of FIG. 1.
Figure 4:
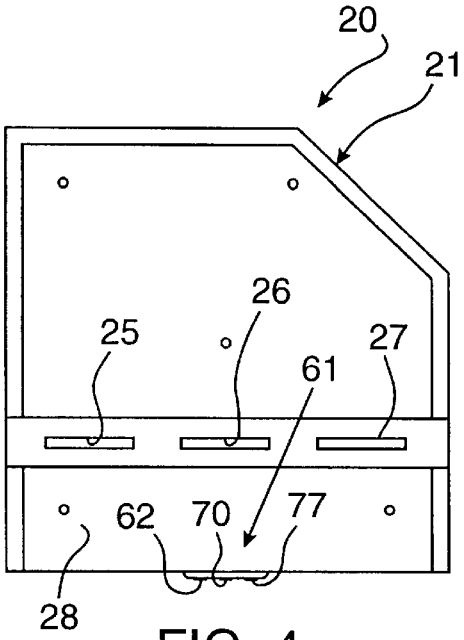
FIG. 4 is a top plan view of the cash box assembly of FIG. 1.
Figure 5:
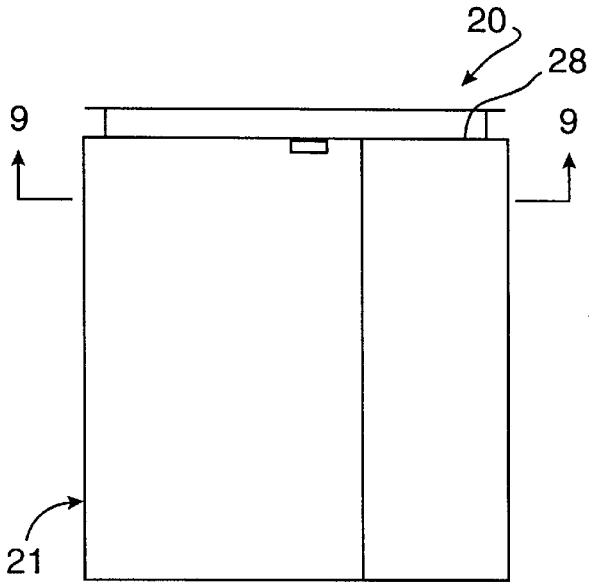
FIG. 5 is a rear elevation view of the cash box assembly of FIG. 1.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Attention is now directed to FIGS. 1, 6 and 9–11 where a multiple compartment cash box assembly, generally designated 20, is provided having a sleeve member 21 defining an insert opening 22 into a recess 23 thereof. The sleeve member 21 includes a first sleeve slot 25, a second sleeve slot 26 and a third sleeve slot 27 each extending into the recess 23 from an exterior surface 28 of the sleeve member. An insert box, generally designated 30, is formed and dimensioned for sliding receipt through the insert opening 22 and into the recess 23 of the sleeve member 21. As best viewed in FIGS. 9–11, the insert box includes a first compartment 31, a separate second compartment 32 and a separate third compartment 33. A first partition 35 separates the first compartment 31 from the second compartment 32, while a second partition 36 separates the second compartment 32 and the third compartment 33.

The insert box 30 includes a first box slot 37 extending into the first compartment 31, a second box slot 38 extending into the second compartment 32 and a third box slot 40 extending into the third compartment 33. The first box slot 37, the second box slot 38 and the third box slot 40 are each configured to align with the respective first sleeve slot 25, the second sleeve slot 26 and the third sleeve slot 27 when the insert box is received in the sleeve member 21.

The cash box assembly further includes an access template, generally designated 41, extending transversely across the first compartment 31, the second compartment 32 and the third compartment 33. This access template 41 is adapted for sliding receipt (in the direction of arrow 42) in a first opening 43 of the first partition 35 and in a second opening 45 in the second partition 36 for movement between a first position (FIG. 9), a second position (FIG. 10) and a third position (FIG. 11). In the first position, the access template 41 cooperates with the first box slot 37 to enable access therethrough into the first compartment 31, while cooperatively blocking access to the second compartment 32 through the second box slot 38 and the third compartment 33 through the third box slot 40. The access template 41 in the second position (FIG. 10) cooperates with the second box slot 38 to enable access therethrough into the second compartment 32, while cooperatively blocking access to the first compartment 31 through the first box slot 37 and the third compartment 33 through the third box slot 40. Finally, in third position (FIG. 11), the access template 41 cooperates with the third box slot 40 to enable access therethrough into the third compartment 33, while cooperatively blocking access to the first compartment 31 through the first box slot 37 and to the second compartment 32 through the second box slot 38.

Figure 9:
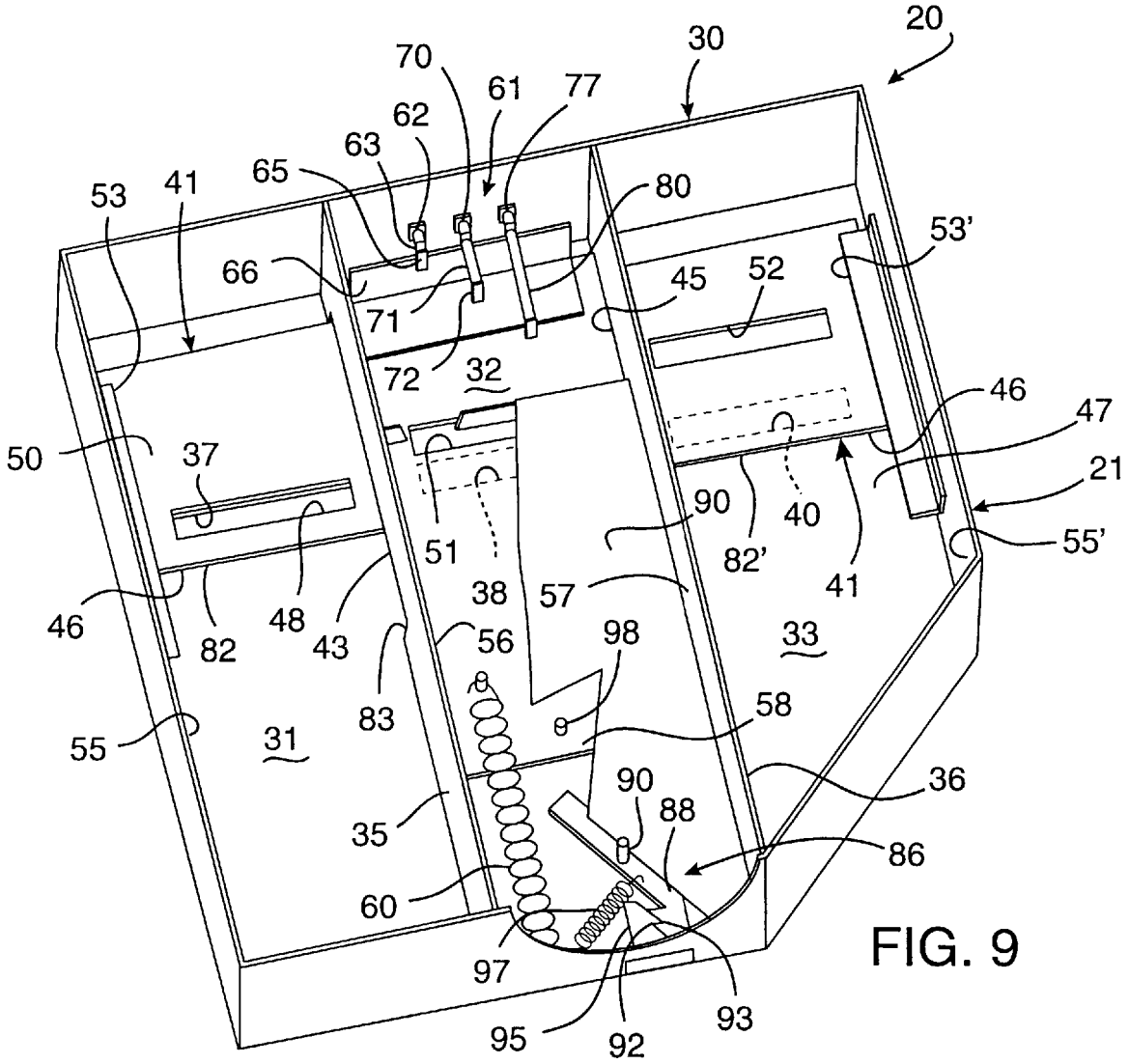
FIG. 9 is an enlarged bottom perspective view, partially broken away, of the insert box taken substantially along the plane of the line 9—9 in FIG. 5, and illustrating an access template in a first position or a day shift orientation.

Accordingly, the present invention is particularly suitable for use as a money collection device for gaming tables (not shown) which are commonly employed in the gaming industry. The access template may be advanced by a manager or other authorized personnel during each shift so that only one compartment will be accessible during that shift change for the deposition of money through the respective slots. For example, as shown in FIG. 9, in the first position, deposition access to the first compartment may be provided for those employees working the day shift, while access to the second and third compartments will be denied. Similarly, in the second position (FIG. 10), deposition access to the second compartment may be provided for those employees working the swing shift, while access to the first and third compartments will be denied. Finally, in the third position (FIG. 11), deposition access to the third compartment may be provided during the graveyard shift, while access to the first and second compartments will be denied. Hence, the cash box assembly of the present invention may be attached to the gaming table throughout the entire day. Only one removal of the cash box assembly is required each day rather than just before each shift change which results in reduced labor costs.

In the preferred form, the access template 41 is plate-like having a substantially planar rear wall 46 in sliding support against a substantially planar contact wall 47 of insert box 30. The access template is further oriented to extend transversely across each compartment in a manner positioned over first sleeve slot 25, second sleeve slot 26 and/or third sleeve slot in one of the first position, the second position and/or the third position. In the first compartment 31, access template 41 provides a first access aperture 48 which extends therethrough from a front wall 50 to the rear wall 46. When the access template is situated in the first position in FIG. 9, first access aperture 48 is positioned in alignment with first box slot 37 which in turn is aligned with first sleeve slot 25.

Accordingly, in this arrangement, money may be positioned through first sleeve slot 25, first box slot 37 and first access aperture 48 for deposition into first compartment 31. Simultaneously, FIG. 9 illustrates that access template 41 extends over the second box slot 38 and the third box slot 40 in the first position. Access is thus denied to the second and third compartments so that deposition or removal therefrom will not be permitted.

Figure 10:
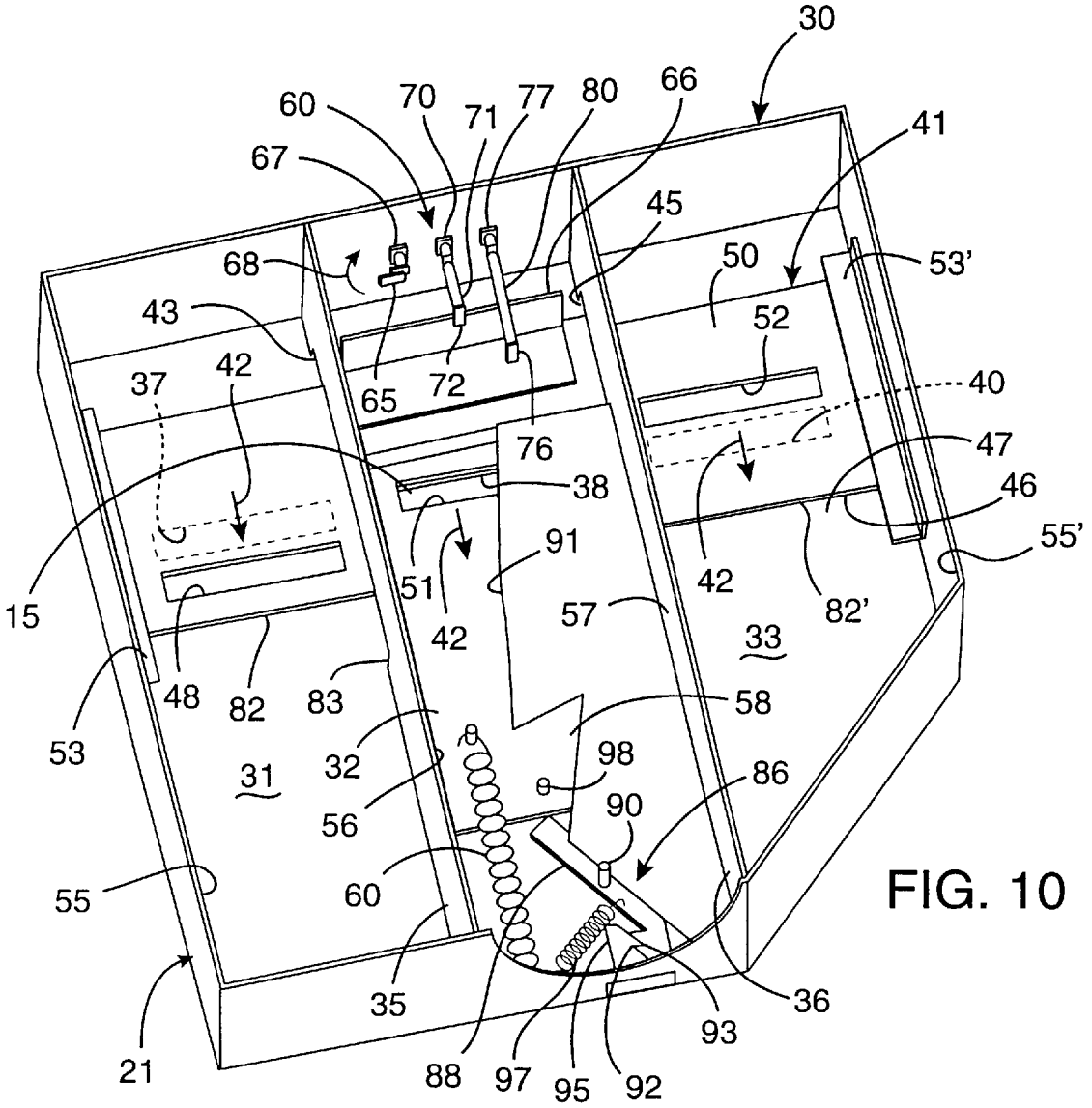
FIG. 10 is a bottom perspective view, partially broken away, of the insert box of FIG. 9 illustrating the access template in a second position or swing shift orientation.
Figure 11:
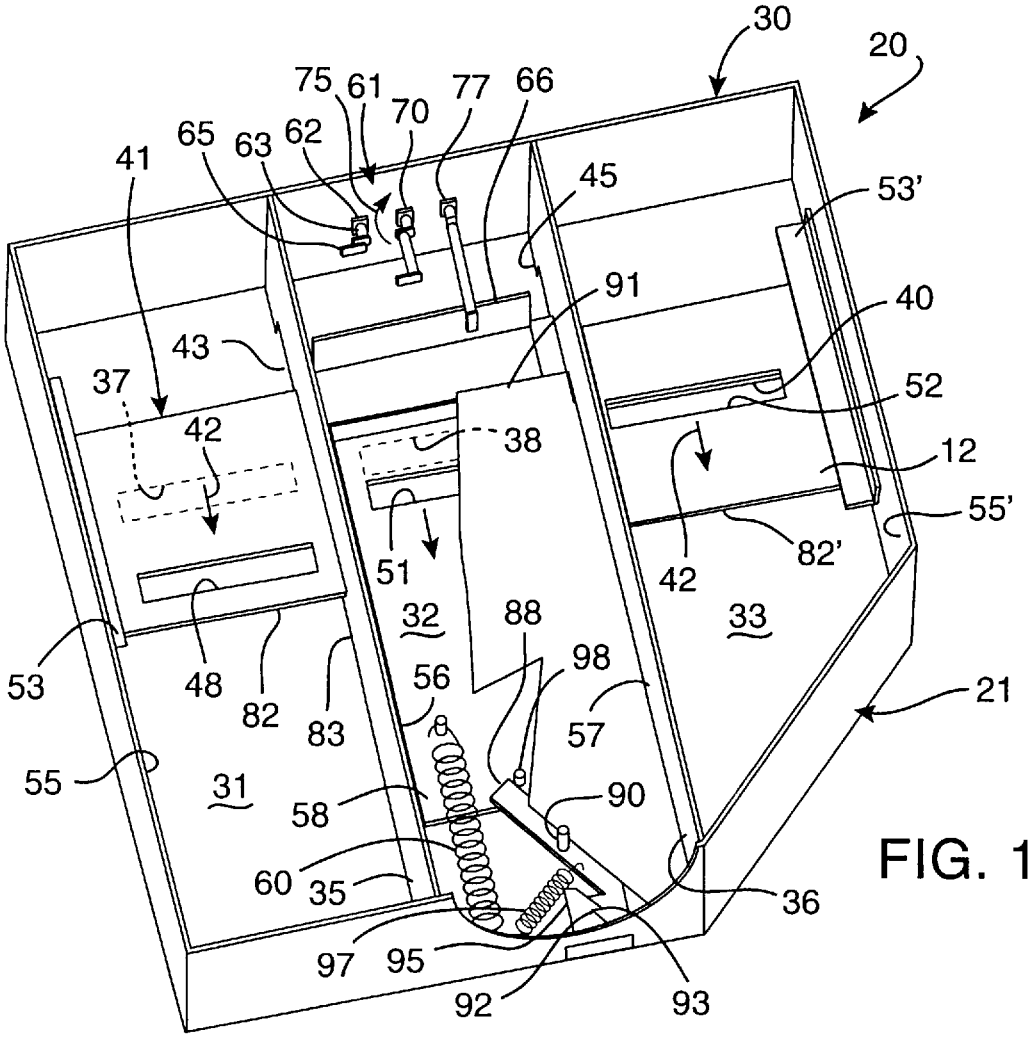
FIG. 11 is a bottom perspective view, partially broken away, of the insert box of FIG. 9 illustrating the access template in a third position or a graveyard swing shift orientation.

When a shift change occurs (i.e., from the day shift to the swing shift), a manager or other authorized personnel may advance the access template 41 (as will be discussed) in the direction of arrow 42 which slides the access template from the first position to the second position (FIG. 10). As the access template moves toward the second position, the first access aperture 48 is advanced past and beyond the first box slot 37, thereby denying access to the first compartment 31. In the second compartment 32, however, access template 41 includes a second access aperture 51 which is advanced into alignment with second box slot 38, enabling access to the second compartment through second sleeve slot 26.

Similarly, when the next shift change occurs (i.e., from the swing shift to the graveyard shift), the access template 41 is again advanced in the direction of arrow 42 which slides the access template from the second position (FIG. 10) to the third position (FIG. 11). As the access template moves toward the third position, the second access aperture 51 is advanced past and beyond the second box slot 38, thereby again denying access to the second compartment 32 while access to the first compartment remains denied. FIG. 11 illustrates that in the third compartment 33, access template 41 includes a third access aperture 52 which is advanced into alignment with third box slot 40. In this orientation, access to the third compartment is provided through third sleeve slot 27.

In the preferred embodiment, access template 41 cooperates with the first partition 35 and second partition 36 for sliding, aligned movement between the first position, the second position and the third position. FIG. 10 best illustrates that access template 41 is slideably received in the first opening 43 of the first partition 35 and in the second opening 45 of the second partition 36 as the template moves in the direction of arrow 42. Further, the opposed ends of access template 41 are slideably secured to the insert box 30 between the contact wall 47 and L-shaped support brackets 53, 53' mounted to the opposed walls 55, 55' of the insert box 30.

Each partition 35, 36 is preferably plate-like having opposed interior walls 56, 57 facing one another and defining a portion of second compartment 32. These interior walls are substantially planar and parallel to one another extending longitudinally in the direction of arrow 42 in FIG. 10. These parallel walls cooperate with an alignment portion 58 of access template 41 to longitudinally align the access template relative the insert box 30 during substantially linear movement between the first position and the third position.

As best viewed in FIGS. 9–11, the first access aperture 48, the second access aperture 51 and a third access aperture 52 are oriented in a stepped arrangement relative one another to enable a staggered access as the access template is advanced between the first position and the third position. Further, the access apertures are preferably sized and dimensioned to substantially conform with the perimeters of the respective first, second and third box slots, when aligned therewith with an alignment mechanism as set forth below.

To facilitate movement toward the second and third positions, a template biasing device, generally designated 60, is provided urging and biasing the access template toward the third position in the direction of arrow 42. In the preferred form, template biasing device 60 is provided by a coil or tension spring having one end mounted to the access template 41 and an opposite end coupled to the insert box 30.

In accordance with the present invention, a latch mechanism 61 is coupled between the insert box 30 and the access template for selective movement thereof between the first position and the third position. Upon manual operation of the latch mechanism 61 by authorized personnel, the access template may be advanced toward the second position due to the biased nature of biasing device 60. Latch mechanism 61 preferably includes a first latch device 62 having an elongated first latch arm 63 rotatably mounted to the insert box 30. A first foot portion 65 is mounted to the distal end of first latch arm 63 and is selectively rotatable between a first latched position (FIG. 9) and a first unlatched position (FIG. 10). In the first latched position, the first foot portion 65 contacts an L-shaped slide stop 66 extending outwardly from access template 41. This contact prevents movement of access template 41 from the first position to the second position. Moreover, the alignment mechanism of the present invention is preferably provided by the strategic positioning of the foot portion which orients the first access aperture 48 of the access template in alignment with the first box slot 37.

The first latch device 62 includes a first lock member which requires a key or the like to permit rotational movement of the first latch arm 63 and the first foot portion 65 from the first latched position to the first unlatched position. Upon rotational motion about first latch arm 63, in the direction of arrow 68 (FIG. 10), the first foot portion 65 is moved out of engagement with the slide stop which enables the biasing device 60 to urge the access template toward the second position.

The latch mechanism 61 further includes a second latch device 70 having a second latch arm 71 and a second foot portion 72 both of which are rotatably mounted to insert box 30. As shown in FIGS. 9 and 10, the second foot portion 72 is already situated in a second latched position so the slide stop 66 of access template 41 will contact therewith to retain the same in the second position. Similarly, this contact prevents movement of access template 41 from the second position to the third position (FIG. 11) by the biasing device 60. Further, the alignment mechanism includes the second foot portion 72 which is positioned to contact the slide stop 66 at the second position which orients the second access aperture 51 in alignment with the second box slot 38.

A second lock member of the second latch device 70 preferably requires a separate key to enable rotational movement of the second latch arm 71 and the second foot portion 72 from the second latched position to the second unlatched position. Upon operation of the second lock member, the second foot portion 72 may be rotated in the direction of arrow 75 (FIG. 11) toward the second unlatched position and out of engagement with the slide stop 66. Subsequently, the biasing device 60 urges the access template 41 toward the third position until the slide stop 66 contacts a third foot portion 76 of a third latch device 77 oriented in a third latched position.

Figure 12:
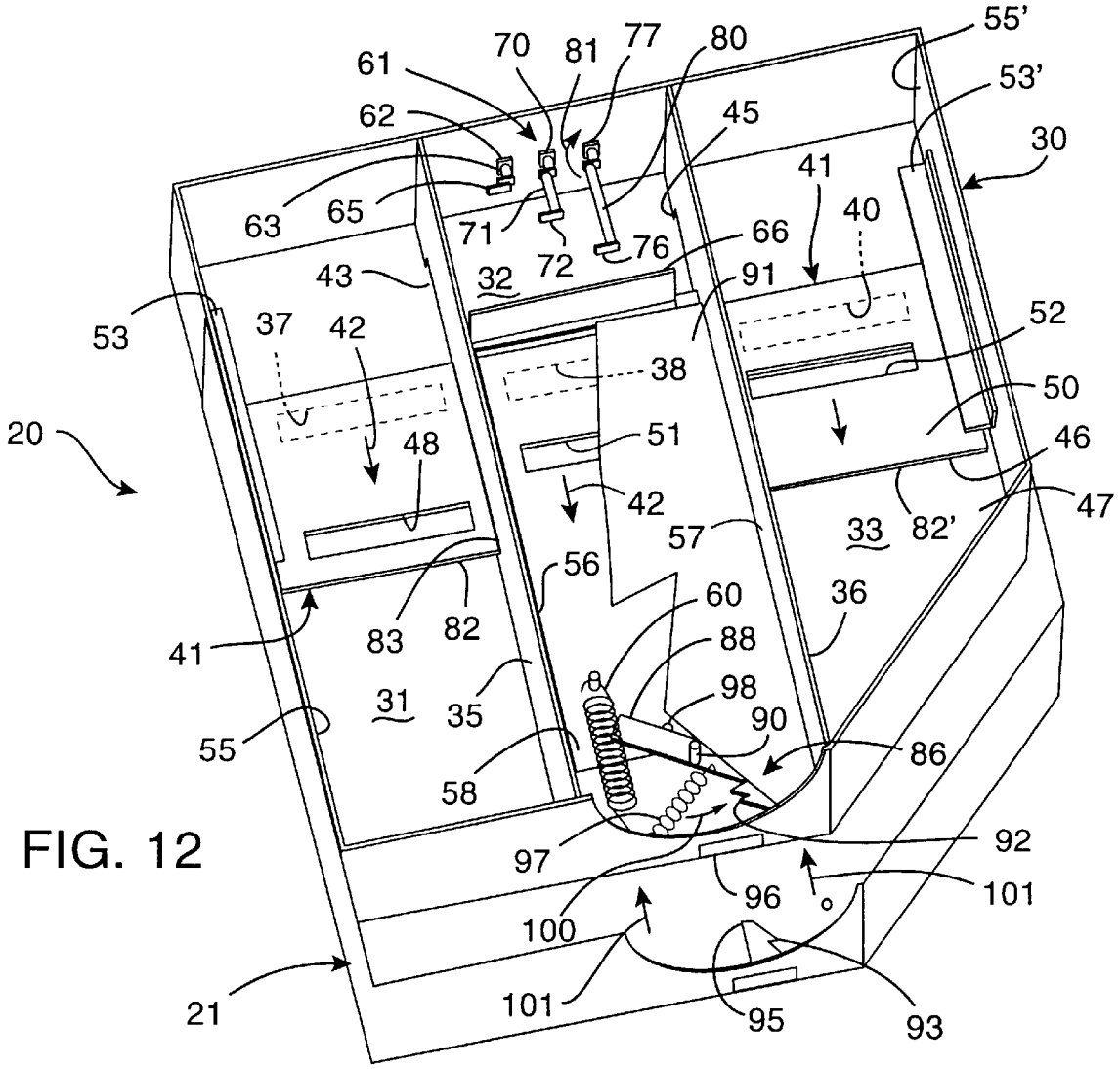
FIG. 12 is a bottom perspective view, partially broken away, of the insert box of FIG. 9 illustrating the access template in a release position or a removal orientation.

Once the access template is positioned in the third position (e.g., for the duration of the graveyard shift), the authorized personnel may operate a third lock member of the third latch device 77 with another separate key (not shown). As shown in FIG. 12, the third latch arm 80 and the distal mounted third foot portion 76 are caused to rotate in the direction of arrow 81 from the third latched position (FIG. 11) to a third unlatched position. This disengagement between the third foot portion 76 and the slide stop 66 enables the access template to move, via biasing device 60, from the third position (FIG. 11) to a release position (FIG. 12). The third access aperture 52 of access template 41 is subsequently advanced from alignment with the third box slot 40 to again deny access to the third compartment. Accordingly, when in the release position, deposition access will be denied to all of the compartments through the box slots by the access template.

To limit travel of the access template 41 in the release position, a contact edge 82, 82' of the access template abuts an end portion 83 of the respective first partition 35 and second partition 36 (not shown) which define the respective first opening 43 and second opening 45. At this orientation, as shown in FIG. 12, the access template extends over all the box slots so that access is denied to all compartments through the sleeve slots.

Figure 6:
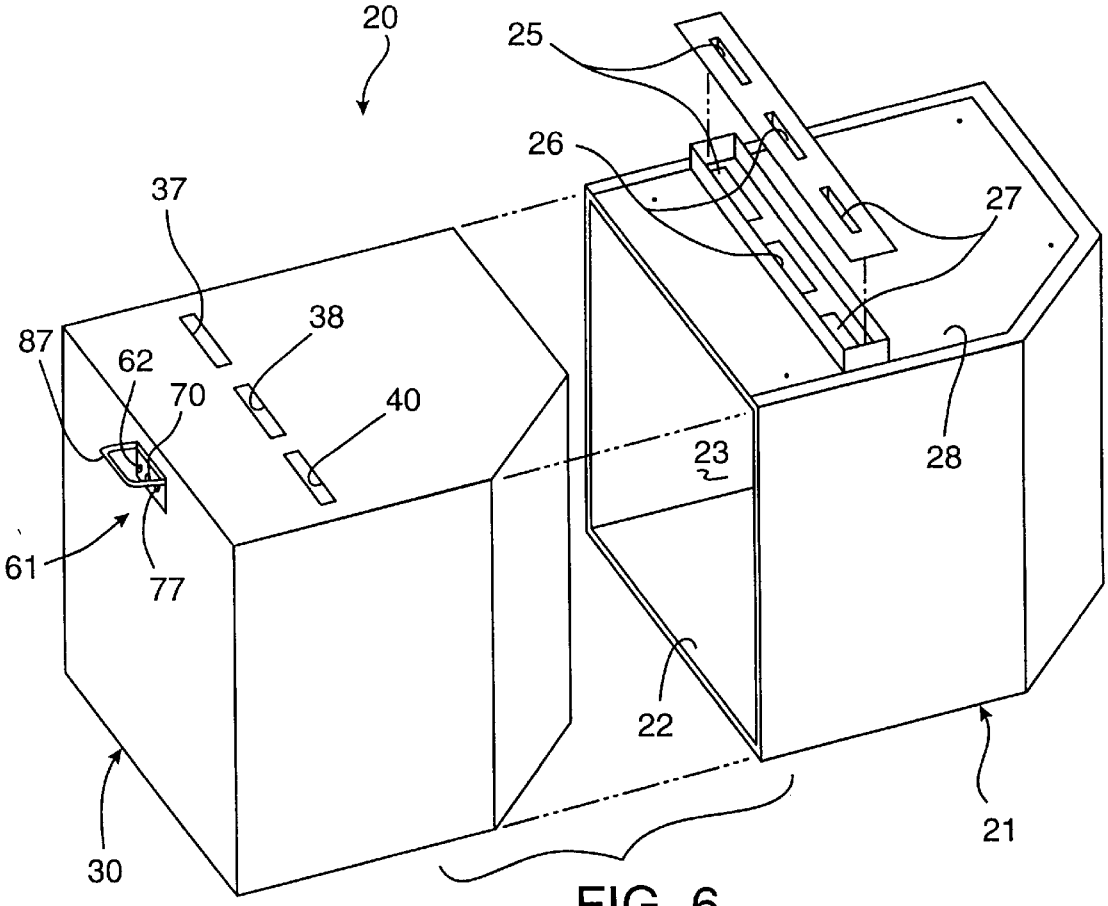
FIG. 6 is an exploded top perspective view of the cash box assembly of FIG. 1 illustrating an insert box separated from a sleeve member, and the money drop slot separated from the sleeve member.
Figure 7:
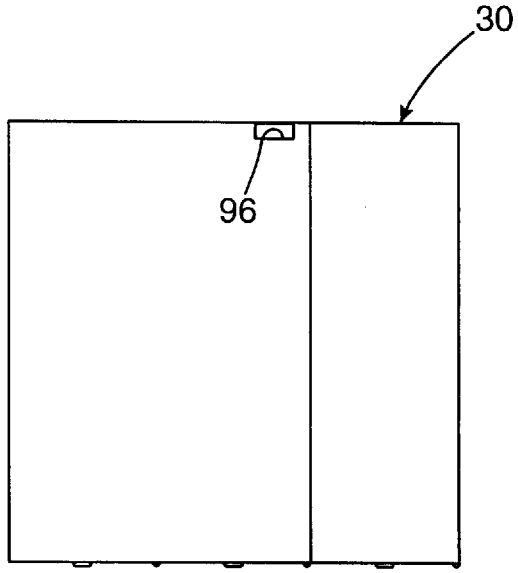
FIG. 7 is a rear elevation view of the insert box of FIG. 6.

In accordance with the present invention, a locking mechanism 86 is included coupled between insert box 30 and sleeve member 21 which selectively lock the insert box to the sleeve member. The locking mechanism is movable between a locked position (FIGS. 9–11), locking insert box 30 in the recess 23 of sleeve member 21, and an unlocked position (FIG. 12), enabling removal of the insert box from the sleeve member. For example, as shown in FIG. 6, at the end of the graveyard shift, the insert box 30 may be removed from the sleeve member 21 which may be mounted to the gaming table. A handle 87 may be included to facilitate manual removal.

In the preferred embodiment, the locking mechanism 86 is operably coupled to access template 41 so that when the template is moved to the release position, the locking mechanism is moved to the unlocked position to enable removal of the insert box 30 from the sleeve member 21. Briefly, as best shown in FIGS. 10–12, locking mechanism 86 includes a lock arm 88 pivotally mounted to insert box about pivot pin 90 between the contact wall 47 and a cover plate 91, shown partially cutaway. One end portion of lock arm 88 includes a plurality of saw teeth 92 which are configured lockably engage and mesh with the saw teeth 93 of a mating lock arm 95 when the insert box is fully received in the sleeve member and the locking mechanism is situated in the locked position. As shown in FIG. 12, the mating lock arm 95 is coupled to sleeve member 21, and extends outwardly toward insert box 30 and into the second compartment 32 through lock slot 96 to engage lock arm 88.

A lock arm biasing device 97 or a coil spring biases the lock arm toward the locked position. However, when access template 41 is permitted to slideably move to the release position, a contact pin 98 mounted to the access template contacts the opposing end of lock arm 88 (FIGS. 11 and 12). This arrangement causes the lock arm 88 to pivot about pivot pin 90, in the direction of arrow 100, to the unlocked position such that the saw teeth 92 of lock arm 88 disengage with the saw teeth 93 of the mating lock arm 95. Subsequently, the insert box 30 may then be removed from the sleeve member in the direction of arrow 101 in FIG. 12.

It will be appreciated that once the access template is reset back toward the first position, the contact pin 98 disengages with lock arm 88 such that the lock arm biasing device 97 moves the lock arm back toward the locked position. Accordingly, upon insertion of insert box back into sleeve member 21, the saw teeth 93 mating lock arm 95 are inserted through lock slot 96 for automatic engagement with the saw teeth 92 of lock arm 88.

Figure 8:
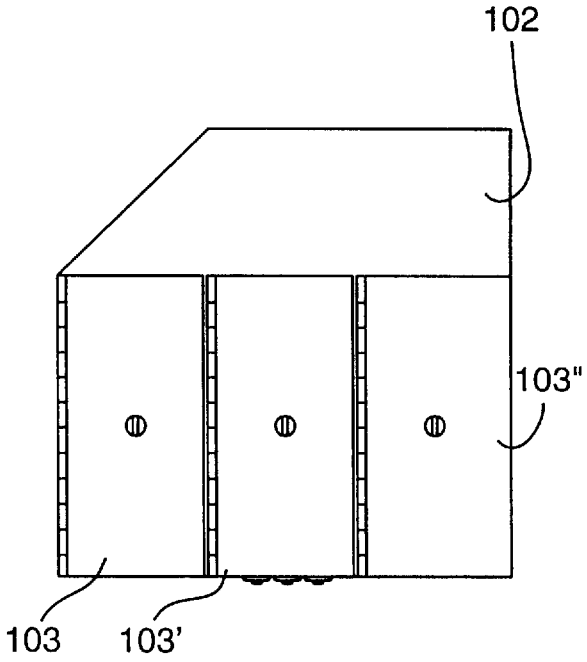
FIG. 8 is a bottom plan view of the insert box of FIG. 6.

After removal of the insert box 30, FIG. 8 best illustrates that a bottom panel 102 of the box includes individual lock doors 103, 103' and 103" corresponding to each compartment. Thus, the first, second and third compartments can be opened individually in a count room for counting.

It will further be appreciated that the cash box assembly of the present invention could contemplate two compartments or four or more compartments without departing from the true spirit and nature of the present invention. In another embodiment, the invention could be used for collection of cash for a multiple array of tickets at a theater or sporting event or off-track betting house or the like.

What is claimed and desired to be protected by Letters Patent of the United States is:

1. A multiple compartment cash box assembly comprising:

an insert box defining a first compartment and a separate second compartment, and having a first slot extending into said first compartment and a second slot extending into said second compartment;

an access template movably coupled to said insert box between a first position, cooperating with said first slot to enable access therethrough into said first compartment while cooperatively blocking access to said second compartment through said second slot, and a second position, cooperating with said second slot to enable access therethrough into said second compartment while cooperatively blocking access to said first compartment through said first slot; and a biasing device adapted to bias one of said access template and said insert box toward said second position.

2. The multiple compartment cash box assembly according to claim 1 wherein, said access template includes a first access aperture extending therethrough which is configured to align with said first slot in said first position, and includes a second access aperture extending therethrough which is configured to align with said second slot in said second position.

3. The multiple compartment cash box assembly according to claim 2 wherein, said access template is slideably mounted to said insert box.

4. The multiple compartment cash box assembly according to claim 3 wherein said access template includes a rear wall, defining said first and second access apertures, in sliding support against a contact wall, defining said first and second slots, of said insert box.

5. The multiple compartment cash box assembly according to claim 4 wherein, said rear wall and said contact wall are substantially planar.

6. The multiple compartment cash box assembly according to claim 3 further including:

a partition separating the first compartment from said second compartment, and including an opening formed and dimensioned for sliding receipt of the access template between the first position and the second position.

7. The multiple compartment cash box assembly according to claim 6 wherein, said access template is configured to cooperate with said partition for sliding alignment between the first position and the second position.

8. The multiple compartment cash box assembly according to claim 1 wherein, said biasing device is a tension spring.

9. The multiple compartment cash box assembly according to claim 3 further including:

a latch mechanism selectively movable between a latched position, preventing movement of said access template from the first position to the second position, and an unlatched position, enabling movement of said access template between the first position and the second position.

10. The multiple compartment cash box assembly according to claim 8 wherein, said latch mechanism includes a latch arm having a foot portion adapted to engage said access template in said latched position, and to disengage said access template when moved to said unlatched position.

11. The multiple compartment cash box assembly according to claim 10 further including:

a sliding stop portion coupled to and extending outwardly from access template for engagement with said foot portion in the latched position.

12. The multiple compartment cash box assembly according to claim 2 further including:

a sleeve member formed and dimensioned for sliding receipt of said insert box therein.

13. The multiple compartment cash box assembly according to claim 12 further including:

a locking mechanism selectively movable between a locked position, locking said insert box in said sleeve member, and an unlocked position, enabling removal of said insert box from said sleeve member.

14. The multiple compartment cash box assembly according to claim 13 wherein, said access template is further adapted to selectively move from the second position to a release position, cooperating with said locking mechanism for movement from said locked position to said unlocked position.

15. The multiple compartment cash box assembly according to claim 14 wherein, said access template is formed to cooperatively block access to both said first compartment through said first slot and said second compartment through said second slot in the release position.

16. The multiple compartment cash box assembly according to claim 15 further including:

a first latch device selectively movable between a first latched position, preventing movement of said access template from the first position to the second position, and a first unlatched position, enabling movement of said access template between the first position and the second position; and a second latch device selectively movable between a second latched position, preventing movement of said access template from the second position to the release position, and a second unlatched condition, enabling movement of said access template between the second position and the release position.

17. The multiple compartment cash box assembly according to claim 16 wherein, said biasing device biases said access template toward said second position and said release position.

18. A multiple compartment cash box assembly comprising:

a sleeve member defining an insert opening into a recess thereof, and including a first sleeve slot, a second sleeve slot and a third sleeve slot each extending into said recess from an exterior surface of said sleeve member;

an insert box formed and dimensioned for sliding receipt through said insert opening and into said recess of the sleeve member, said insert box defining a first compartment, a separate second compartment and a separate third compartment, said first compartment and said second compartment being separated by a first partition extending therebetween and said second compartment and said third compartment being separated by a second partition extending therebetween, said insert box including a first box slot extending into said first compartment, a second box slot extending into said second compartment and a third box slot extending into said third compartment, each said first box slot, said second box slot and said third box slot configured to align with the respective first sleeve slot, the second sleeve slot and the third sleeve slot when said insert box is received in said sleeve member; and an access template extending transversely across said first compartment, said second compartment and said third compartment, and adapted for sliding receipt in a first opening of said first partition and a second opening in the second partition between a first position, cooperating with said first box slot to enable access therethrough into said first compartment while cooperatively blocking access to said second compartment through said second box slot and said third compartment through said third box slot, a second position, cooperating with said second box slot to enable access therethrough into said second compartment while cooperatively blocking access to said first compartment through said first box slot and said third compartment through said third box slot, and a third position, cooperating with said third box slot to enable access therethrough into said third compartment while cooperatively blocking access to said first compartment through said first box slot and to said second compartment through said second box slot.

19. The multiple compartment cash box assembly according to claim 18 wherein, said access template includes a first access aperture extending therethrough which is configured to align with said first box slot in said first position, a second access aperture extending therethrough which is configured to align with said second box slot in said second position, and a third access aperture extending therethrough which is configured to align with said third box slot in said third position.

20. The multiple compartment cash box assembly according to claim 18 wherein, said access template is configured to cooperate with said first partition and said second partition for sliding alignment between the first position, the second position and the third position.

21. The multiple compartment cash box assembly according to claim 19 wherein, said first partition provides a substantially planar interior wall and said second partition provides an opposed substantially planar interior wall, and said access template including an alignment portion having opposed side edges slideably contacting the opposed interior walls of the respective first and second partitions for aligned linear movement thereof between the first position, the second position and the third position.

22. The multiple compartment cash box assembly according to claim 18 further including:

a latch mechanism coupled between the insert box and the access template for selective movement of the access template from the first position to the second position, and from the second position to the third position.

23. The multiple compartment cash box assembly according to claim 22 wherein, said latch mechanism includes:

a first latch device selectively movable between a first latched position, preventing movement of said access template from the first position to the second position, and a first unlatched position, enabling movement of said access template between the first position and the second position, and, a second latch device selectively movable between a second latched position, preventing movement of said access template from the second position to the third position, and a second unlatched position, enabling movement of said access template between the second position and the third position.

24. The multiple compartment cash box assembly according to claim 23 wherein, said first latch device includes a first latch arm having a first foot portion adapted to engage said access template in said first latched position, and to disengage said access template when moved to said first unlatched position, and said second latch device includes a second latch arm having a second foot portion adapted to engage said access template in said second latched position, and to disengage said access template when moved to said second unlatched position.

25. The multiple compartment cash box assembly according to claim 24 further including:

a sliding stop portion coupled to and extending outwardly from access template for engagement with said first foot portion in the first latched position and engagement with said second foot portion in the second latched position.

26. The multiple compartment cash box assembly according to claim 25 further including:

a biasing device biasing said access template toward said second position and said third position.

27. The multiple compartment cash box assembly according to claim 22 further including:

a locking mechanism movable between a locked position, locking said insert box in said sleeve member, and an unlocked position, enabling removal of said insert box from said sleeve member.

28. The multiple compartment cash box assembly according to claim 27 wherein, said access template is further adapted to selectively move from the third position to a release position, cooperating with said locking mechanism for movement from said locked position to said unlocked position.

29. The multiple compartment cash box assembly according to claim 28 further including:

a biasing device biasing said access template toward said second position, said third position and said release position.

30. A multiple compartment cash box assembly comprising:

an insert box defining a first compartment and a separate second compartment, and having a first slot extending into said first compartment and a second slot extending into said second compartment;

an access template movably coupled to said insert box between a first position, cooperating with said first slot to enable access therethrough into said first compartment while cooperatively blocking access to said second compartment through said second slot, and a second position, cooperating with said second slot to enable access therethrough into said second compartment while cooperatively blocking access to said first compartment through said first slot; and a partition separating the first compartment from said second compartment, and including an opening formed and dimensioned for moving receipt of the access template between the first position and the second position.

31. The multiple compartment cash box assembly according to claim 30 wherein, said access template includes a first access aperture extending therethrough which is configured to align with said first slot in said first position, and includes a second access aperture extending therethrough which is configured to align with said second slot in said second position.

32. The multiple compartment cash box assembly according to claim 30 wherein, said access template is slideably mounted to said insert box.

33. The multiple compartment cash box assembly according to claim 32 wherein, said access template is configured to cooperate with said partition for sliding alignment between the first position and the second position.

34. The multiple compartment cash box assembly according to claim 30 further including:

a latch mechanism selectively movable between a latched position, preventing movement of said access template from the first position to the second position, and an unlatched position, enabling movement of said access template between the first position and the second position.

35. A multiple compartment cash box assembly comprising:

an insert box defining an interior portion having a first compartment and a separate second compartment, and including a first slot extending into said first compartment and a second slot extending into said second compartment;

an access template movably coupled in the interior portion of said insert box between a first position, cooperating with said first slot to enable access therethrough into said first compartment while cooperatively blocking access to said second compartment through said second slot, and a second position, cooperating with said second slot to enable access therethrough into said second compartment while cooperatively blocking access to said first compartment through said first slot; and an alignment mechanism adapted to cooperate with said access template to automatically align said first slot relative said access template in said first position for access to said first compartment, and to align said second slot relative said access template in said second position for access to said second compartment.

36. The multiple compartment cash box assembly according to claim 35 wherein, said access template includes a first access aperture extending therethrough which is configured to cooperate with said alignment mechanism to align with said first slot in said first position, and includes a second access aperture extending therethrough which is configured to cooperate with said alignment mechanism to align with said second slot in said second position.

37. The multiple compartment cash box assembly according to claim 35 further including:

a biasing device which biases said access template toward said second position.

38. The multiple compartment cash box assembly according to claim 35 further including:

said alignment mechanism includes a latch mechanism selectively movable between a latched position, preventing movement of said access template from the first position to the second position and aligning with said first slot such that said access is enabled therethrough into said first compartment, and an unlatched position, enabling movement of said access template between the first position and the second position and aligning with said second slot such that said access is enabled therethrough into said second compartment.

39. The multiple compartment cash box assembly according to claim 38 wherein, said latch mechanism includes a latch arm having a foot portion adapted to engage said access template in said latched position, and to disengage said access template when moved to said unlatched position.

40. The multiple compartment cash box assembly according to claim 39 wherein, said alignment mechanism further includes a sliding stop portion coupled to and extending outwardly from said access template for engagement with said foot portion in the latched position.

41. A multiple compartment cash box assembly comprising:

an insert box defining an interior portion having a first compartment and a separate second compartment, and having a first slot extending into said first compartment and a second slot extending into said second compartment;

an access template movably coupled in the interior portion of said insert box between a first position, cooperating with said first slot to enable access therethrough into said first compartment while cooperatively blocking access to said second compartment through said second slot, and a second position, cooperating with said second slot to enable access therethrough into said second compartment while cooperatively blocking access to said first compartment through said first slot; and a latch mechanism selectively movable between a latched position, preventing movement of said access template from the first position to the second position, and an unlatched position, enabling movement of said access template between the first position and the second position.

42. The multiple compartment cash box assembly according to claim 41 wherein, said access template includes a first access aperture extending therethrough which is configured to align with said first slot in said first position, and includes a second access aperture extending therethrough which is configured to align with said second slot in said second position.

43. The multiple compartment cash box assembly according to claim 41 wherein, said access template is slideably mounted to said insert box.

44. The multiple compartment cash box assembly according to claim 41 wherein, said latch mechanism includes a latch arm having a foot portion adapted to engage said access template in said latched position, and to disengage said access template when moved to said unlatched position.

45. The multiple compartment cash box assembly according to claim 44 further including:

a sliding stop portion coupled to and extending outwardly from access template for engagement with said foot portion in the latched position.

46. A multiple compartment cash box assembly comprising:

an insert box defining a first compartment and a separate second compartment, and having a first slot extending into said first compartment and a second slot extending into said second compartment;

a sleeve member formed and dimensioned for sliding receipt of said insert box therein;

a locking mechanism selectively movable between a locked position, locking said insert box in said sleeve member, and an unlocked position, enabling removal of said insert box from said sleeve member; and an access template movably coupled to said insert box between a first position, cooperating with said first slot to enable access therethrough into said first compartment while cooperatively blocking access to said second compartment through said second slot, and a second position, cooperating with said second slot to enable access therethrough into said second compartment while cooperatively blocking access to said first compartment through said first slot, said access template is further adapted to selectively move from the second position to a release position, cooperating with said locking mechanism for movement from said locked position to said unlocked position, and said access template is formed to cooperatively block access to both said first compartment through said first slot and said second compartment through said second slot in the release position.

47. The multiple compartment cash box assembly according to claim 46 further including:

a first latch device selectively movable between a first latched position, preventing movement of said access template from the first position to the second position, and a first unlatched position, enabling movement of said access template between the first position and the second position; and a second latch device selectively movable between a second latched position, preventing movement of said access template from the second position to the release position, and a second unlatched condition, enabling movement of said access template between the second position and the release position.

48. The multiple compartment cash box assembly according to claim 46 further including:

a biasing device biasing said access template toward said second position and said release position.

49. A multiple compartment cash box assembly comprising:

an insert box defining a first compartment and a separate second compartment, and having a first slot extending into said first compartment from an exterior surface to an interior contact surface, and a second slot extending into said second compartment from said exterior surface to said interior contact surface, said first slot being sized and dimensioned substantially smaller than a transverse cross-sectional dimension of said first compartment, and said second slot being sized and dimensioned substantially smaller than a transverse cross-sectional dimension of said second compartment;

an access template movably coupled to said insert box adjacent said interior contact surface of said insert box between a first position, cooperating with said first slot to enable access therethrough into said first compartment while cooperatively blocking access to said second compartment through said second slot, and a second position, cooperating with said second slot to enable access therethrough into said second compartment while cooperatively blocking access to said first compartment through said first slot.

50. The multiple compartment cash box assembly according to claim 49 wherein, said access template includes a first access aperture extending therethrough which is configured to align with said first slot in said first position, and includes a second access aperture extending therethrough which is configured to align with said second slot in said second position.

51. The multiple compartment cash box assembly according to claim 50 further including:

an alignment mechanism adapted to automatically align said first slot relative said access template in said first position for access to said first compartment, and to align said second slot relative said access template in said second position for access to said second compartment.

52. The multiple compartment cash box assembly according to claim 49 further including:

a biasing device which biases said access template toward said second position.

53. A multiple compartment cash box assembly comprising:

an insert box defining a first compartment and a separate second compartment, and including a first slot extending into said first compartment and a second slot extending into said second compartment;

an access template having a first access aperture and a second access aperture, and movably coupled to said insert box between a first position, cooperating said first access aperture with said first slot to enable access therethrough into said first compartment while cooperatively blocking access to said second compartment through said second slot, and a second position, cooperating said second access aperture with said second slot to enable access therethrough into said second compartment while cooperatively blocking access to said first compartment through said first slot; and an alignment mechanism adapted to cooperate with said access template to automatically align said first slot relative said first access aperture of said access template in said first position for access to said first compartment, and to align said second slot relative said second access aperture of said access template in said second position for access to said second compartment.

54. The multiple compartment cash box assembly according to claim 53 further including:

a biasing device which biases said access template toward said second position.

55. A multiple compartment cash box assembly comprising:

an insert box defining a first compartment and a separate second compartment, and having a first slot extending into said first compartment and a second slot extending into said second compartment;

an access template movably coupled to said insert box between a first position, cooperating with said first slot to enable access therethrough into said first compartment while cooperatively blocking access to said second compartment through said second slot, and a second position, cooperating with said second slot to enable access therethrough into said second compartment while cooperatively blocking access to said first compartment through said first slot; and a latch mechanism including latch arm having a foot portion selectively movable between a latched position, engaging said access template to prevent movement thereof from the first position to the second position, and an unlatched position, disengaging said access template to enable movement thereof between the first position and the second position.

56. The multiple compartment cash box assembly according to claim 55 further including:

a sliding stop portion coupled to and extending outwardly from access template for engagement with said foot portion in the latched position.

* * * * *